United States Patent [19]

Baker et al.

[11] 4,302,209

[45] Nov. 24, 1981

[54] LIGNITE PELLETS AND METHODS OF AGGLOMERATING OR PELLETIZING

[75] Inventors: Albert F. Baker; Eric W. Blaustein; Albert W. Deurbrouck; John P. Garvin; Robert E. McKeever, all of Pittsburgh, Pa.

[73] Assignee: The United States of America as represented by the United States Department of Energy, Washington, D.C.

[21] Appl. No.: 61,874

[22] Filed: Jul. 30, 1979

[51] Int. Cl.[3] ..... C10L 5/02; C10L 5/16

[52] U.S. Cl. ..... 44/10 D; 44/1 G; 44/10 E; 44/23

[58] Field of Search ..... 44/1 G, 1 B, 10 D, 23, 44/10 E

[56] References Cited

U.S. PATENT DOCUMENTS

| | | | |
|---|---|---|---|
| 1,452,992 | 4/1923 | Van Westrum | 44/23 |
| 1,790,356 | 1/1931 | Smith | 44/23 |
| 2,310,095 | 2/1943 | Lance et al. | 44/10 |
| 2,610,115 | 9/1952 | Lykken | 44/1 G |
| 2,819,155 | 1/1958 | Eisenhut et al. | 44/19 |
| 4,095,954 | 6/1978 | Kindl | 44/1 B |

OTHER PUBLICATIONS

Coal Preparation, Joseph W. Leonard, Mining Congress Journal, Feb. 1976, pp. 39–41.

Lignite Beneficiation, Baker et al., Bureau of Mines Research 76, pp. 13–14.

The Encyclopedia of Chemical Process Equipment, William J. Mead, Reinhold Publishing Corp., New York, 1964, pp. 48–70.

*Primary Examiner*—Carl F. Dees

*Attorney, Agent, or Firm*—Lynn J. Alstadt; Hugh Glenn; Richard G. Besha

[57] ABSTRACT

The specification discloses lignite pellets which are relatively hard, dust resistant, of generally uniform size and free from spontaneous ignition and general degradation. Also disclosed are methods for making such pellets which involve crushing as mined lignite, mixing said lignite with a binder such as asphalt, forming the lignite binder mixture into pellets, and drying the pellets.

15 Claims, 2 Drawing Figures

LIGNITE PELLETS AND METHODS OF AGGLOMERATING OR PELLETIZING

Figure 1:
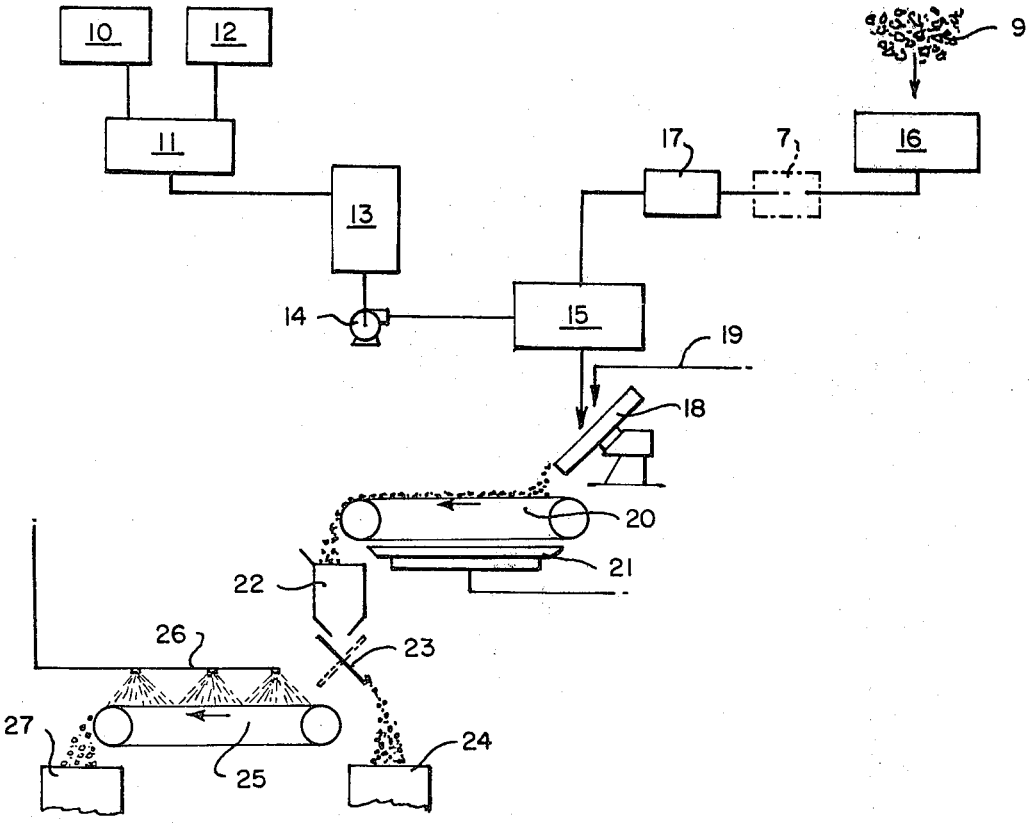

This invention resulted from work done under Contract No. J0377003 with the Bureau of Mines in the Department of Interior and Contract No. ET-77-C-01-9143 with the Department of Energy and is subject to the terms and conditions of the Presidents' Patent Policy Statement of Oct. 10, 1963.

This invention relates to lignite agglomerates and to methods of agglomerating lignite and particularly to a lignite pellet and method of pelletizing which provides a relatively hard, dust resistant, generally uniform size pellet which is free from spontaneous ignition and general degradation.

Lignite is one of the most abundant forms of fossil fuel occurring in very large tonnages in various parts of the world but, because of its nature, one of the least utilized. It is somewhat lower, about 30% to 40%, in B.T.U. value than bituminous coal, very friable and dusty when dried, but high in moisture (35%–60%) as mined. Lignite is highly susceptible to spontaneous combustion after being dried and quickly picks up moisture after drying so that it is very difficult to ship. Since it is so friable when dried, it tends to break up on shipment while at the same time spontaneously igniting in the presence of air. Thus, any opening in the car in which the lignite is shipped is a source of air and of potential spontaneous ignition. As a result, lignite is sheipped wet and its use has been restricted to the area in which the lignite is mined.

In view of the vast tonnages of lignite available, and the low sulfur content, the modification of lignite to make it transportable over long distances has been the subject of much study and research.

Generally, it has been the belief of those interested in modifying lignite that the lignite should be briquetted under pressure with some binding agent to hold the lignite particles and the work which has been done prior to this invention has been generally directed to that area. While briquetting of lignite does solve some of the problems of handling the material, it introduces problems of its own. First, there is the economic burden of providing pressing and forming equipment for forming the briquettes under pressure and the concomitant economic burden of operating them. Second, the resulting briquette is not readily handled in many of the coil handling systems in operation for handling sized bituminous coal. As a result, briquetting has not proven to be a viable method of competitively getting lignite onto the energy scene. Some attempts at pelletizing have been made but these too have been unsuccessful.

We have invented a new lignite agglomerate and method of making the same which solves both the problems of lignite itself and of briquetting. The product of our invention has sufficient compressive strength to make it shippable, may be sized to a uniform selected size on any standard disk or drum pelletizer. The product may be made directly from raw lignite.

We provide a lignite pellet which is low in moisture, free from dusting and crushing in normal handling and has a B.T.U. value of about 9,500 B.T.U./lb.

The pellet of our invention generally consists of lignite particles bound together with about 3% to 10% binders and which have been dried to predetermined moisture level after pelletizing. The process comprises the steps of crushing, as mined, lignite to a size consist suitable for pelletizing, pre-wetting the ground lignite, mixing the ground lignite particles with binder in a suitable mixing device, feeding the mxiture of lignite and binder to a pelletizing device, forming pellets of lignite and binder, transferring the pellets to a drying unit and drying the pellets to a predetermined moisture level. Preferably, the binder is about 3.5%–10% asphalt in an emulsion. Preferably, the lignite is ground to minus 10 mesh or less in size prior to pelletizing. Drying is carried out in circulating air at temperatures up to about 500° F. The final pellet has a moisture content of about 15% to 20% at maximum strength and if not waterproofed can absorb additional water without significant loss of strength and hardness.

Figure 2:
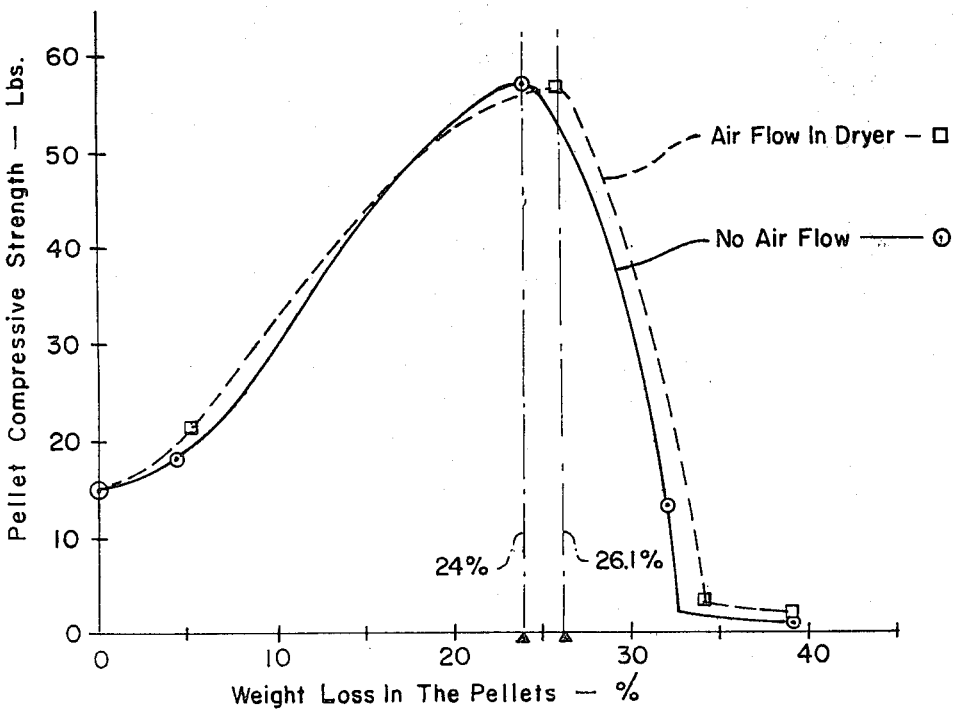

In the foregoing general description we have set out certain objects, purposes and advantages of this invention. Other objects purposes and advantages will be apparent from a consideration of the following description and accompanying drawings in which:

FIG. 1 is a flow diagram of one method of pelletizing according to this invention, and FIG. 2 is a drying curve showing the criticality of drying to the product.

Referring to the drawings, we have illustrated an asphalt heater 10 delivering asphalt to a colloid mill 11 along with heated water from water heater 12. Asphalt emulsion, consisting of about 10% to 50% asphalt and the balance water, from mill 11 goes to an asphalt emulsion tank 13 from which it is pumped by pump 14 to mixer 15. Lignite 9 is delivered to a grinding mill 16 where it is ground to −10 mesh, and pre-dried to a moisture level which allows fluid replacement by prewettng water and asphalt emulsion. Then it passed through a prewetting muller 17 where the ground lignite is pre-wetted, and delivered to a second muller 15 where asphalt emulsion is added in proportions of about 5–10% asphalt to 95–90% ground lignite. Prior to being delivered to the second muller 15 the lignite may be passed through sodium removal system 7, shown in chain line, to reduce the sodium content of the lignite to below 4% of its ash content. We prefer to remove the sodium through ion exchange with a solution of sulfuric acid. This is an optional step which we contemplate will be used when the lignite being processed will be used in equipment that may be damaged by the amount of sodium normally present in lignite. The asphalt emulsion and lignite are thoroughly mixed in mixer 15 and delivered to pelletizer 18 along with water from water line 19. The asphalt and lignite mixture is pelletized to about ¾ inch pellets and discharged to drier belt 20 where hot reversable air streams from line 21 are circulated around the pellets. Although a steady air stream could be used we have found that reversible air streams are more efficient. The hot air may be heated to temperatures of up to 500° F. The pellets from drier belt 20 pass through hopper 22 and are diverted by gate 23 into a container 24 for storage or onto a second conveyor 25 where they are coated with a waterproofing emulsion by sprayer 26 and then discharged into container 27 for storage. Surface waterproofing should be necessary for only those pellets which will be stored outdoors or may otherwise be subject to coming in contact with water. The coated pellets are then carried to off-site storage or transportation carriers for shipment as desired.

In FIG. 2 we have illustrated a drying curve for Knife River, North Dakota lignite which shows the significance of moisture content of the agglomerates or pellets to their strength. The curve for lignites from different areas will vary somewhat but in each case they show a critical peak area of relatively high moisture content where the pellets has, we have discovered, a surprisingly high strength.

In our system the pellets can be readily dried to a moisture level of about 15%. Pellets having the ability to withstand a crushing load of 20 pounds are considered to have sufficient strength to resist degradation during handling and transporting. Lignite pellets of acceptable strengths can be made using our process with a variety of binders; however, their resistance to water varies greatly. Asphalt binders provide the maximum strength and does not contribute additional pollutants. Other binders such as sulfite liquor or starch made reasonably strong pellets but have little resistance to moisture.

We have made pellets using various binders by the sytems outlined in FIGS. 1 and 2. The compressive strengths of pellets made with some of the binders are listed in Table I.

TABLE I

| Binder | Binder % | Crushing Load (lbs.) |
|---|---|---|
| Asphalt Emulsion | 5 | 28 |
| Asphalt Emulsion | 10 | 38 |
| Gilsonite | 5 | 37 |
| Gilsonite | 10 | 28 |
| Sulfite Liquor | 5 | 32 |
| Corn Starch | 3 | 19 |

The significance of drying and heat on the strength of the pellets can be readily seen from the following example. A series of 800 gm. samples of green balls of ground lignite with 10 lb. of asphalt per 100 lb. of B.D. lignite were placed on a perforated screen in a 4 inch deep layer. Hot air was first passed upwardly through the pellets, then reversed and the same hot air passed downwardly through the pellets, for an equal time period. As air temperatures were increased, drying times were decreased in an effort to hold weight loss at a substantially constant value. The samples were cooled and tested for weight loss and compressive strength.

Representative results of these tests appear in the following Table.

Results of High Temperature Drying
All Pellets 10# Asphalt per 100# B.D. Lignite

| Run | Air Inlet °F. | Total Drying Time, Minutes | Weight Loss % | Compressive Strength Lbs. | Maximum Exit Air Temperature Updraft °F. | Maximum Exit Air Temperature Downdraft °F. |
|---|---|---|---|---|---|---|
| 1 | 300 | 10.88 | 22.7 | 35.5 | — | — |
| 2 | 400 | 8.45 | 23.8 | 35.0 | 279 | 304 |
| 3 | 400 | 9.28 | 24.7 | 32.7 | 291 | 302 |
| 4 | 500 | 6.51 | 24.7 | 40.3 | 340 | 365 |
| 5 | 500 | 8.0 | 27.5 | 32.8 | 358 | 379 |
| 6 | 600 | 5.30 | 24.6 | 35.2 | 378 | 424 |
| 7 | 600 | 6.33 | 28.6 | 31.9 | 421 | 426 |

The results show that pellets dried with high temperature air are relatively strong, based on compression tests. At failure, an audible "crack" is heard as the pellet disintegrates.

In the foregoing specification we have set out certain preferred practices and embodiments of our invention; however, it will be understood that this invention may be ;otherwise embodimed within the scope of the following claims.

We claim:

1. A process for producing lignite fuel pellets of high compressive strength comprising the steps of:

crushing as mined lignite to a size suitable for pelletizing;

predrying said lignite to a moisture content which allows fluid replacement;

prewetting said crushed and dried lignite with water;

mixing said prewetted lignite with a binder comprising an asphalt and water emulsion in an amount sufficient on pelletizing and drying to provide strength for handling and shipping;

feeding the mixture of lignite and binder along with water to a pelletizing device having an inclined rotatable surface for receiving said mixture and water;

forming moist pellets of said mixture including lignite with asphalt and water emulsion by rotating said surface to cause a tumbling, cascading action and the adhesion of particles into pellet form; and drying said pellets to a predetermined moisture level.

2. A process as claimed in claim 2 wherein the lignite is reduced to minus 10 mesh and pellets of about ¾ inch are formed of said lignite and binder mixture.

3. The process of claim 1 wherein the lignite is simultanteously crushed and pre-dried in air swept milling equipment.

4. A process as claimed in claim 1 wherein the pelletizer is a disk pelletizer.

5. A process as claimed in claim 1 wherein the pelletizer is a balling drum.

6. A process as claimed in claim 1 wherein the pellets are dried in circulating air at a temperature up to about 500° F.

7. A process as claimed in claim 6 wherein the air is circulated in reversable air streams.

8. A process as claimed in claim 1 wherein the dried pellets are coated with an outer film of emulsion.

9. A process as claimed in claim 8 wherein the film of emulsion is applied by spraying.

10. A process as claimed in claim 1 wherein the pellets are dried to a moisture content of about 15% to 30% with heated air in the range 300° to 600° F.

11. The process of claim 1 also comprising the step of contacting said crushed lignite with a solution of sulfuric acid to exchange hydrogen ions for sodium ions thereby removing sodium from the lignite.

12. The process of claim 11 wherein sufficient amount of sodium are removed to make the sodium content of the lignite lower than 4% of the ash content of the lignite.

13. The process of claim 1 wherein additional water is sprayed onto said mixture of lignite and asphalt and water emulsion while forming pellets thereof.

14. The process of claim 1 wherein said pellets are dried to a moisture content of 15 to 30%.

15. The process of claim 14 wherein said pellets are dried to a moisture content of 15 to 20%.

* * * * *